United States Patent [19]

Roespel et al.

[11] 4,149,135

[45] Apr. 10, 1979

[54] ELECTRICAL COIL AND METHOD OF PRODUCING THE SAME

[75] Inventors: Gustav Roespel, Unterhaching; Horst Scheffler, Munich, both of Fed. Rep. of Germany

[73] Assignee: Siemens Aktiengesellschaft, Berlin & Munich, Fed. Rep. of Germany

[21] Appl. No.: 787,599

[22] Filed: Apr. 14, 1977

[30] Foreign Application Priority Data

Apr. 21, 1976 [DE] Fed. Rep. of Germany ..... 2617465

[51] Int. Cl.[2] ..... H01F 15/02; H01F 41/02

[52] U.S. Cl. ..... 336/65; 29/605; 336/83; 336/192

[58] Field of Search ..... 336/65, 96, 192, 83, 336/90, 92, 94; 29/602 R, 605, 606

[56] References Cited

U.S. PATENT DOCUMENTS

| | | | |
|---|---|---|---|
| 1,367,957 | 2/1921 | Garretson | 336/83 |
| 2,439,277 | 4/1948 | Walker | 336/83 X |
| 3,507,039 | 4/1970 | Craige | 336/83 X |
| 3,824,518 | 7/1974 | Slenker | 336/96 |
| 3,973,321 | 8/1976 | Horton | 336/83 X |

FOREIGN PATENT DOCUMENTS

| | | | |
|---|---|---|---|
| 919690 | 4/1947 | France | 336/83 |
| 17222 of | 1906 | United Kingdom | 336/83 |

*Primary Examiner*—Thomas J. Kozma
*Attorney, Agent, or Firm*—Hill, Gross, Simpson, Van Santen, Steadman, Chiara & Simpson

[57] ABSTRACT

An electrical coil having a protective cap, a round ferrite core, an electrical winding and connective elements, which in assembly is suitable for installation in enveloped layer circuits, is comprised of a round core which is positioned, in one piece, on a ferrite base plate, a protective cap is secured onto the ferrite base plate and a winding is positioned about the core and has wire ends which are brought into contact, within the interior of the protective cap, with the connective elements which have a portion thereof arranged on the base plate surface facing away from the core and outside the interior of the protective cap.

6 Claims, 12 Drawing Figures

ELECTRICAL COIL AND METHOD OF PRODUCING THE SAME

BACKGROUND OF THE INVENTION

The invention relates to electrical coils and methods of producing the same and somewhat more particularly to an electrical coil having a protective cap, a round ferrite core, a winding and connective elements which, when assembled, are suitable for installation in an enveloped layered surface.

Inexpensively designed and economically producible hybridization-suitable coils having fixed inductances are required for layered circuits. In this regard, small chips with adjoining connective elements which may be brought into contact with the layered circuits in a conventional manner, are preferred as hybridization-suitable coil construction forms.

SUMMARY OF THE INVENTION

The invention provides an inexpensive electrical coil of the type earlier described whereby the coil may be jacketed or enveloped without damage and can be brought into contact with a layered circuit with a minimum of expense. The invention also provides a process for economically manufacturing such hybridization-suitable electrical coils.

In accordance with the principles of the invention, a round ferrite core is positioned, in one piece, on a ferrite base plate and a protective cap is secured on such base plate. Ends of a wire winding, which may be a spoolless winding, are brought into contact within the interior of the protective cap with connective elements which have a portion thereof arranged outside the interior of the cap and are secured on the base plate surface which faces away from the round core. In certain embodiments, the connective elements are strip-shaped and enclose the ferrite base plate in a claw-like manner. Such connective elements may be positioned within grooves provided on the narrow or vertical side surfaces of the ferrite base plate. In certain embodiments, the connective elements are secured, as with a suitable adhesive, to the ferrite base plate at least on a flat or horizontal surface thereof which faces away from the core. In certain embodiments, the protective cap is composed of a ferrite. In the process embodiments, a perforated transport band, which may be a metal sheet or a metal-plastic lamina, having bendable and punchable strip-shaped connective elements, is transported stepwise through a plurality of work steps wherein at the respective successive steps the following operations occur: the connective element ends are bent perpendicularly to the plane of the transport band, the round core mounted on a ferrite base plate is positioned between the upright connective element ends, the core is fixed in position, as by bending the free ends of the connective elements toward each other, the core is wound with the winding wire ends being brought into contact with the connective element ends and the remaining wire removed, the protective cap is cemented or bonded onto the ferrite base plate about the core and the connection or contact area between the winding ends and the conductive elements, the bond is hardened and the resultant electrical coil is separated from the transport band by punching out portions of the connective elements which secure such elements to the transport band.

DESCRIPTION OF THE PREFERRED EMBODIMENTS

Figure 1A:
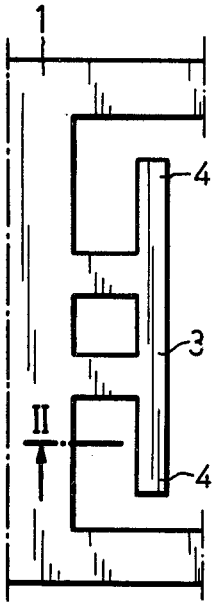
FIGS. 1*a* through 1*f* are schematic, partially broken-away, plan views of a transport band undergoing sequential assembly of an electrical coil in accordance with the principles of the invention.

The invention provides an economical hydridization-suitable electrical coil especially useful for installation in an enveloped or jacketed layer circuit and an economical process for the manufacture of such coils.

Electrical coils produced in accordance with the principles of the invention can be jacketed without damage and can be brought into contact with a layered circuit with a minimum of expense.

In accordance with the principles of the invention, a round ferrite core is positioned, in one piece, upon a horizontal flat surface of a ferrite base plate having opposing flat surfaces separated from one another by upstanding or vertical relatively narrow side surfaces. A protective cap, which may be comprised of a ferrite, is cemented or secured onto the ferrite base plate and about the core. The core is then wound and the winding wire ends are brought into contact with portions of connective elements located within the interior of the protective cap. The connective elements, which have another portion thereof arranged outside the interior of the protective cap, rest or are secured on a flat surface of the base plate which faces away from the round core.

The connective elements, which in preferred embodiments are positioned in suitable grooves provided along the narrow upstanding or vertical side surfaces of the ferrite base plate, are preferably strip-shaped and enclose the ferrite base plate in a claw-like manner. The connective elements may be secured, as by a suitable adhesive, to a ferrite base plate on at least a surface thereof which faces away from the round core.

The protective cap, which is cupped over the wound core and secured to the ferrite base plate, completes or supplements the electrical coil to a parallelepied-shaped chip which in its interior comprises a completely protected winding and a protected contact area between the coil wire ends and the connective elements.

In order to achieve sufficient shielding and in order to achieve a high $A_L$ value, i.e., an inductivity factor, a protective cap composed of a ferrite is preferred. With this type of construction, one can grind off the top flange of the round core or the edge of the protective cap so as to adjust the air gap between the protective gap and the top of the round core flange and thereby achieve a desired $A_L$ value.

In the method embodiments of the invention, a perforated transport band, which may comprise a sheet of metal or a metal-synthetic material (plastic) lamina, having strip-shaped connective elements attached thereto, which elements can be bent and punched out is transported stepwise through a plurality of work stations or steps whereat the assembly of the coil is accomplished. (In instances where the transport band comprises a metal-plastic lamina, the strip-shaped connective elements are defined by etching the lamina so as to uncover the conductive elements.) The respective steps are performed in succession and preferably automatically by appropriate means. In the first step, the connective element ends are bent upwardly so as to be substantially perpendicular to the plane of the transport band. In the next step, the round core attached to a ferrite base plate is positioned between the upright connective element ends. The core is then fixed in position, as by bending the free connective element ends toward one another or by bonding the base plate onto the unbent portions of the conductive elements. Next, the core is wound and the ends of the winding wire are brought into contact with the conductive element ends while any excess winding wire is removed, as by severing. Finally, the protective cap is bonded onto the ferrite base plate, the bond cured or hardened and the resulting electrical coil is separated from the transport band, as by punching out the connecting portions between the band and the connective elements.

Figure 2A:
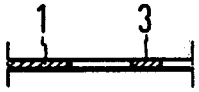
FIGS. 2*a* through 2*f* are somewhat similar, partially cut-away, side views.
Figure 2B:
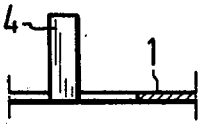
Figure 2C:
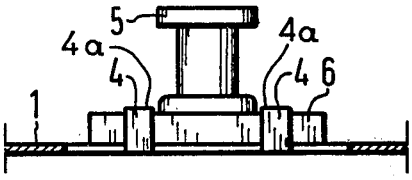
Figure 2D:
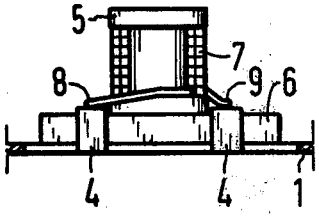
Figure 2E:
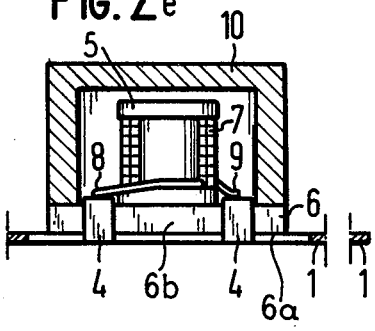
Figure 2F:
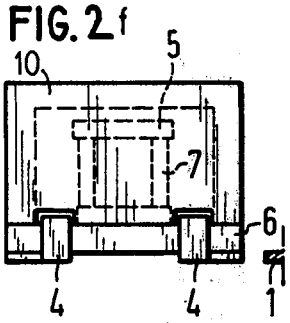

Referring now to the drawings, wherein like reference numerals refer to like elements and particularly to FIG. 2*e*, wherein an electrical coil constructed in accordance with the principles of the invention is illustrated. As shown, such an electrical coil is comprised of a round ferrite core 5, wound with a winding 7 and mounted on a one-piece ferrite base plate 6. Strip-shaped connective elements are secured to the base plate 6 on a flat bottom surface 6*a* thereof which faces away from the core 5. Ends 4 of such connective elements are positioned within grooves (not shown) in the upright or narrow side surfaces 6*b* of the base plate so as to enclose the base plate in a claw-like manner. A protective cap 10, which may, for example, comprise a parallelepied-shaped member composed of a ferrite or of an insulating material, is cemented or bonded onto the ferrite base plate 6 so as to encompass the core 5. The respective winding wire ends 8 and 9 are secured in contact with the connective element ends, for example, as by welding, within the enclosed space jacketed by the protective cap 10. The portion of each connective element which faces away from the interior of the protective cap rests on the outside or underside of the ferrite base plate 6. The ferrite may be a Ni-Zn-ferrite composed of the initial oxides 51 mol% $Fe_2O_3$, 13 mol% ZnO, 35 1 mol% NiO, 1 mol% MnO, containing additionally 0.17 weight percent $V_2O_5$ and 0.55 weight percent CoO. As adhesive may be used a polyimid-adhesive.

Figure 1B:
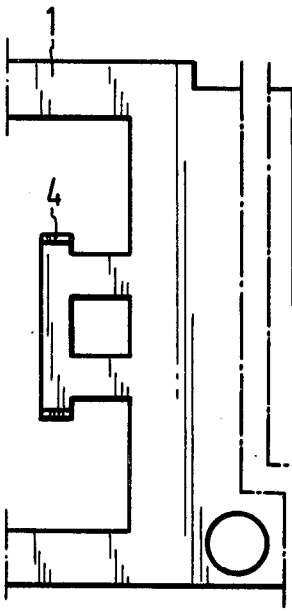
Figure 1C:
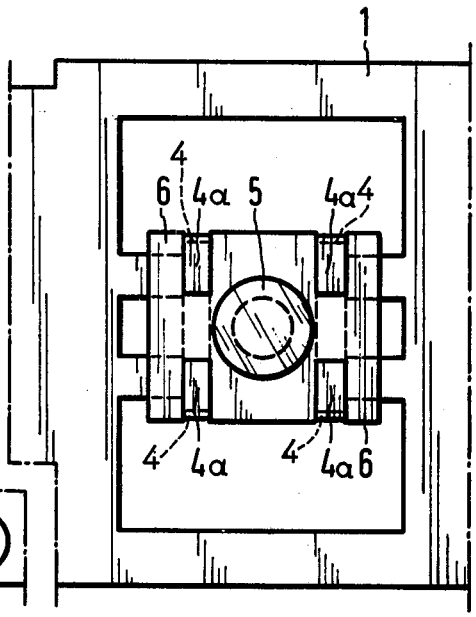
Figure 1D:
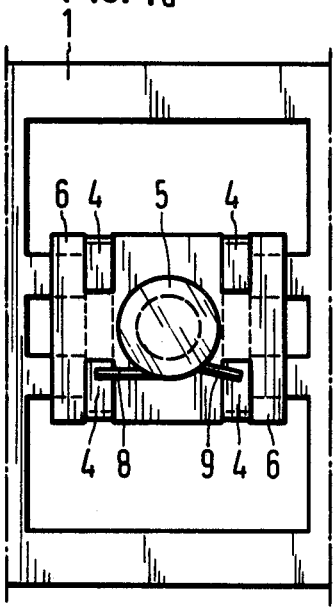
Figure 1E:
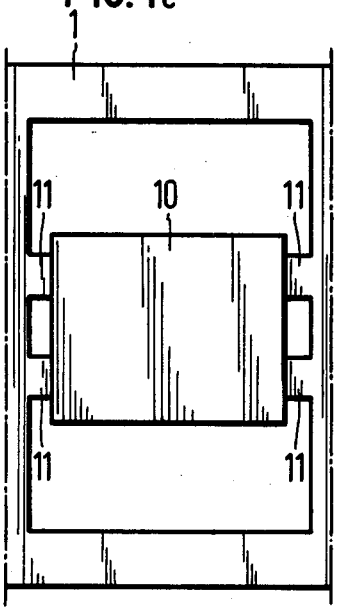
Figure 1F:
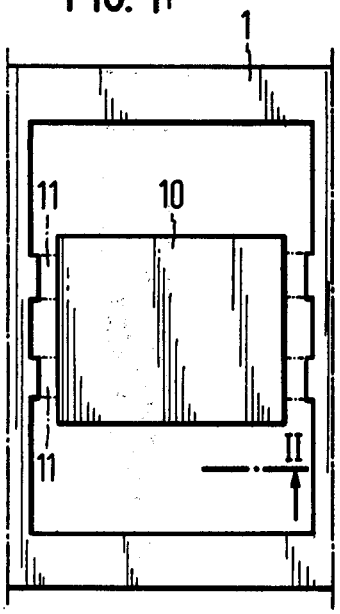

In a process of producing such electrical coils, which is schematically illustrated in FIGS. 1*a* through 1*f*, a perforated transport and assembly band 1 having at least one bendable and punchable strip-shaped connective element 3, such as shown at FIG. 1*a*, is successively transported, preferably automatically, through a plurality of steps necessary to manufacture the coil. In the respective steps illustrated successively in FIGS. 1*b* through 1*f*, the connective element ends 4 are bent perpendicularly to the plane of the transport band 1 (FIG. 1*b*). The round core 5 with an attached ferrite base plate 6 is then positioned between the upright connective element ends 4 (FIG. 1*c*). The core 5 is then fixed in position, as by bending the free connective element ends 4*a* toward each other (FIG. 1*c*), and the round core is wound with a winding wire so that the winding wire ends 8 and 9 are brought into contact with portions of the connective elements 4 and the remaining wire is removed (FIG. 1*d*). The protective cap 10 is then positioned so as to enclose the core 5, the winding 7 and the contact area between the winding ends 8 and 9 and the connective elements 4. The protective cap is then bonded onto the ferrite base plate 6 and the bond is cured or hardened. The resulting coil structure is then separated from the transport band 1 by punching out part 11 (FIGS. 1*e* and 1*f*). Thereafter, conventional electrical testing and marking of the coil may take place.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention except as it is set forth and defined in the hereto-appended claims.

We claim as our invention:

1. In an electrical coil having a protective cap, a round ferrite core, an electrical winding and connective elements useful for installation in an enclosed layered circuit, the improvement wherein:

the round core is positioned, in one piece, on a ferrite base plate and the protective cap is secured onto the base plate and about the core, the winding wire ends are positioned in contact with portions of connective elements located within the interior of the protective cap, with another portion of the connective elements being located outside the interior of the protective cap and resting on a surface of the base plate which is facing away from the core, and the connective elements are strip-shaped and enclose the ferrite base plate in a claw-like manner.

2. In an electrical coil as defined in claim 1 wherein said ferrite base plate includes vertical side surfaces having grooves therein and the strip-shaped connective elements are positioned in said grooves.

3. In an electrical coil as defined in claim 1 wherein said connective elements are secured to the ferrite base plate at least on a flat surface of the base plate which faces away from the round core.

4. In an electrical coil as defined in claim 1 wherein said protective cap is comprised of a ferrite.

5. A process for producing an electrical coil having a protective cap, a round ferrite core mounted on a ferrite base plate, an electrical winding and connective elements, comprising:

providing a perforated transport band having bendable and punchable strip-shaped connective elments and stepwise moving such band through successive steps so that the following operations occur:

bending the connective element ends perpendicularly to the plane of the transport band;

positioning the round core mounted on the ferrite base plate between the bent connective element ends;

fixing such core in position by bending the free ends of the connective elements toward each other and into contact with a surface of the base plate which supports the core;

winding the core with the electrical winding so that the winding wire ends are brought into contact with the connective element ends in contact with the surface of the base plate which supports the core;

bonding the protective cap onto the ferrite base so that the core, the winding and the contact area between the ends of the winding and the connective element ends are enclosed within the interior of such protective cap; and separating the resultant electrical coil from the transport band by punching out portions of the connective elements securing such elements to the transport band.

6. A process as defined in claim 5 wherein the transport band comprises a metal-plastic lamina having strip-shaped connective elements thereon defined by etching such lamina; and the round core is fixed in position by bonding the base plate onto the connective elements.

* * * * *